US006626500B1

(12) United States Patent
Cribb et al.

(10) Patent No.: US 6,626,500 B1
(45) Date of Patent: Sep. 30, 2003

(54) ROTARY DRUM CUTTING HEAD

(75) Inventors: Robert W. Cribb, Silverwater (AU); Norman R. Cribb, Silverwater (AU); David G. Slade, Silverwater (AU)

(73) Assignee: RN Cribb Pty Limited, Silverwater (AU)

( * ) Notice: Subject to any disclaimer, the term of this patent is extended or adjusted under 35 U.S.C. 154(b) by 0 days.

(21) Appl. No.: 09/857,955

(22) PCT Filed: Dec. 13, 1999

(86) PCT No.: PCT/AU99/01117

§ 371 (c)(1),
(2), (4) Date: Aug. 21, 2001

(87) PCT Pub. No.: WO00/36230

PCT Pub. Date: Jun. 22, 2000

(30) Foreign Application Priority Data

Dec. 11, 1998 (AU) ..... PP 7645

(51) Int. Cl.[7] ..... E21C 25/08; E21C 25/19
(52) U.S. Cl. ..... 299/78; 299/39.8; 299/41.1
(58) Field of Search ..... 299/29, 39.1, 39.4, 299/39.8, 41.1, 76, 77, 78, 79.1, 85.1

(56) References Cited

U.S. PATENT DOCUMENTS 3,290,096 A * 12/1966 Stalker ..... 299/78
3,712,678 A * 1/1973 Amoroso ..... 299/68
3,897,109 A * 7/1975 Satterwhite ..... 299/39.8
4,098,539 A * 7/1978 Zitz et al. ..... 299/75
4,172,616 A 10/1979 Delli-Gatti, Jr. ..... 299/80
4,785,559 A * 11/1988 Hentschel ..... 37/94
4,883,134 A 11/1989 Bollinger et al. ..... 37/91
5,975,644 A * 11/1999 Lang ..... 299/39.4
6,270,163 B1 * 8/2001 Mullet et al. ..... 299/75

FOREIGN PATENT DOCUMENTS

| | | |
|---|---|---|
| DE | 19539249 | 4/1996 |
| GB | 1047472 | 11/1966 |
| GB | 1359204 | 7/1974 |
| GB | 1419714 | 12/1975 |
| SU | 1239311 | 6/1986 |

* cited by examiner

*Primary Examiner*—David Bagnell
*Assistant Examiner*—Daniel P Stephenson
(74) *Attorney, Agent, or Firm*—Sheridan Ross PC

(57) ABSTRACT

A rotary drum cutting head (40) has pair of rotary drums (16, 18) which present a plurality of cutting implements (42) adapted for milling rock or other excavatable terrain, and a hydraulic motor (46) centrally disposed between the pair of rotary drums (16, 18). The hydraulic motor (46) has a rotatable output shaft (50) to which the drums (16, 18) arm rigidly and directly connected at opposed driven ends (83) of the shaft (50) the opposed driven ends (83) extending in opposite directions from the hydraulic motor (46) in longitudinal alignment with the rotational axis (20) of the rotary drum (16, 18) and rotatably supporting the rotary drums (16, 18).

7 Claims, 5 Drawing Sheets

ROTARY DRUM CUTTING HEAD

FIELD OF INVENTION

The present invention relates to a rotary drum cutting head for milling rock or other excavatable terrain and, in particular, to a cutting head that presents cutting implements, such as spirally arranged picks, on a pair of hydraulically driven rotary drums, the cutting drum being driven by a hydraulic motor via a shaft without the interposition of gearing. The invention has particular application as an attachment to a mobile hydraulic plant, such as a hydraulic excavator, backhoe or underground mining machinery.

BACKGROUND ART

Conventional rotary drum cutting heads, also known as milling cutters or facing heads, are driven by a hydraulic motor (normally fed with oil under pressure from the hydraulic circuitry of an excavator). One such example uses a multi-gear drive train that rotatably connects the drive shaft of the hydraulic motor (located within the cutting head adaptor for the dipper arm of the excavator) to the driven shaft(s) of the rotary drums. The drive shaft is, as a result, perpendicularly aligned with the driven shaft(s). The drive train itself consists of a train of drive shaft aligned reduction gears acting on a crown wheel and pinion that, in turn, acts on planetary gears for the driven shaft(s).

Due to the many working or moving components of this drive train, some efficiency is lost, such as through friction, and maintenance and overhaul of the drive train can be tedious, time consuming and expensive.

Other examples of prior art rotary drum cutting heads have been the subject of published patents, the following sample of which identify numerous configurations of gears and/or semi-flexible joints utilized hitherto.

U.S. Pat. Nos. 4,172,616 and 4,883,134, GB Patents 1,419,714 and 1,047,472, DE Patent 19,539,249 and SU Patent 1,239,311 all disclose machinery that utilise gears and/or semi flexible joints to transmit energy to the cutting drums.

The cutting drum for a mining machine of U.S. Pat. No. 4,172,616 has two spaced apart body portions, one of which is driven by a shaft of an interior motor through reduction planetary gears. Specifically, this patent describes a single stage planetary gear reduction arrangement in which a sun gear is formed on the shaft, and there is a planet carrier and a stationary ring housing. The planet carrier has a plurality of planetary gears mounted thereon, each of the plurality of planetary gears being in operative association with the sun gear, and the planet carrier operatively connected to the first body portion. The stationary ring housing is operatively connected to a supporting arm and is concentric with an interior of the first body portion. Gear means are formed on the interior of the ring housing. The planetary gears operatively engage the gear means and the sun gear.

The milling apparatus of U.S. Pat. No. 4,883,134 has (in the embodiment of its FIG. 2) two opposed semi-drums rotatably mounted on fixed plates by bearings (such as roller bearings), which rotationally bear against a ring gear fixed to each semi-drum. The motor for the apparatus has a hollow drive shaft with internal grooves which correspond to grooves on a driven shaft which drives the semi-drums. A grooved plate gear fits in grooves at the extremities of driven shaft and rotates in unison with the driven shaft. The circumference of the plate gear is joined to the ring gear or crown of the semi-drum by grooves, whereby rotation of the plate gear causes rotation of its semi-drum through engagement with the ring gear. The grooves serve the purpose of gear teeth or splines to provide a non-reducing 1:1 gear ratio.

In the embodiment of FIG. 3 of U.S. Pat. No. 4,883,134, the semi-drums are made to rotate by a driving gear train turning on shaft joined to bearing support plates. These gears engage, on one hand, in grooves at each extremity of shaft and, on the other hand, on a groove on a ring gear fixed to each semi-drum. By selecting the respective diameters of the shaft and gears, the semi-drums may be made to turn at a different speed to that of motor.

The mining cutting tool of GB 1,419,714 has a hydraulic motor and a gear unit secured thereto. The gear unit has a drive shaft which is provided with a flange opposite to which is a coupling ring fixed to a cutting drum. The flange and coupling ring have apertures which are aligned and distributed about their circumference and which each contain a clamping sleeve having longitudinal slot arrangements that enable the transfer of the moment of rotation from flange to coupling ring.

The mining machine of GB 1,047,472 has a cutter drum and a hydraulic motor for driving the drum. A vertical shaft passes centrally through the drum, and the motor is coaxial about the shaft and has a rotor formed with internal teeth which mesh with an externally toothed portion of the shaft. The drive from the shaft to the drum is effected by a gear wheel keyed on the shaft and meshing with pinions secured on a stub shaft jouralled in a fixed support arm for the vertical shaft. The teeth of pinions engage in respective slots cut in the drum.

The rotary tool for digging trenches of DE 19,539,249 has two coaxially mounted half drums connected to a shaft driven by internal motors. A plate gear, fixed at each end of, and rotatable with, the shaft, is connected by a groove or spline (unnumbered) to a ring gear, supported by bearings, which carry the half drums.

The actuating unit for a cutter SU 1,239,311 has a drum connected to hub by a set of discs mounted on splines of the drum housing and on splines of a cover secured to the hub.

The utilization of gears and/or semi-flexible joints in the above examples of the prior art causes problems in view of the working environment of the cutting drums. Because of the variation of pressure between the workface and the rotating drum which is an inherent result of the design of the mobile hydraulic plant, such as an excavator, the speed of rotation of the drum will vary between slow and fast. Consequently, a major problem with the prior art has been that of gradual, but significant, wearing and damage caused to the gears and/or joints by the frequent backlash experienced when the drum suddenly changes its rotational speed when it interacts with the workface.

It would be beneficial to avoid the use of gears and/or semi-flexible joints altogether so as to prolong the working life and maintenance-free operating periods of rotary drum cutting heads.

GB Patent 1,359,204 discloses a mining cutting tool having a cutting drum which has one or more hydraulic motor of the radial piston type mounted at least partly within the cutting drum and arranged to drive the cutting drum without the interposition of any gears. The hydraulic motors used in this mining cutting tool are of the kind normally utilized for the radial movement and loadings typically required by winches, supported drive shafts and the like that have a slow moving operation and would not be suitable for use in a rotary drum cutting head for milling rock or other excavatable terrain. The mining cutting tool of GB 1,359,204 was subsequently modified in GB 1,419,714 (described earlier) to provide for higher moments of rotation of the cutting drum.

Specifically, the mining cutting tool of GB 1,359,204 has (in the embodiment of its FIG. 1) a pair of hydraulic motors possessing internally located stationary parts (which serve as shafts) and externally located rotating parts. The stationary parts are secured to respective support arms of a forked carrier of a vehicle, which support arms are disposed at opposed external positions of the cutting drum. A cutting drum is flange mounted to each of the rotating parts. The support arms have located therein hydraulic fluid lines. The presence of the external support arms and their housing of the hydraulic fluid lines prevent the embodiment of FIG. 1 being used effectively as a versatile attachment for an excavator (even if the hydraulic motor used for this cutting tool were suitable). For instance, the excavation of trenches and rectangular pits with dimensional precision requires that the cutting implements on the drum be given unimpeded access to the workface so that only the cutting implements make contact with the workface. However, the external support arms would impede access of the cutting drum to confined workfaces and also not allow the cutting drum to be operated shearingly across a workface as the external support arms would got in the way of the cutting drum. In fact, the presence of the external support arms would only allow the cutting drum to have access to a workface from a direction perpendicular to the plane of the workface, and not from a direction parallel to the plane of the workface. Furthermore, the external support arms would physically prevent the excavation of a trench or pit of any substantial depth, and the normal jolting motion of the cutting drum during excavation of an existing trench or pit would cause the external support arms to collide with the walls of the trench and damage not only the arms but also the hydraulic fluid lines located therein.

In the embodiment of FIG. 2 of GS 1,359,204, a cutting head carrier or support arm is centrally located between a pair of drums, each of which is driven by a separate hydraulic motor. Each drum is flange mounted to a rotating part of one of the hydraulic motors which also has a stationary part attached to the carrier. The utilization in this embodiment of separate stationary parts (serving as stationary support shafts) for the motors to support the independent rotation of the rotating parts (serving as rotating output shafts) for each motor upon which a drum is mounted, is technically unacceptable and unsound for a heavy duty excavator attachment. The degree of mechanical instability of the drums with respect to the two stationary support shafts upon which separate hydraulic motors operate would be so high as to compromise the performance of the mining cutting tool. Furthermore, because of the energy imparted by the excavator, the stationary parts should be in one piece, not two, a present consequence of which is that unacceptably low moments of force during the cutting process are transmitted through the shafts to the cutting drums. Also, the presence of a single supply and return circuit for hydraulic fluid means that if one drum experiences significant back pressure sufficient to stop its rotation, the other drum would be accelerated in its rotation, the result of which may be that the accelerated drum exceeds its optimal speed and causes subsequent internal mechanical problems. The stopped drum will remain stationary for so long as the back pressure remains significant, with the consequence that mechanical and hydraulic damage could result.

The embodiment of FIG. 3 of GB 1,359,204 utilizes a single external support arm or cutting head carrier at one side of the single drum. The carrier has fastened thereto a stationary part of a hydraulic motor, the rotating part of the motor being screwed to an intermediate shaft to which the single drum is keyed. The cantilevered nature of this embodiment renders it unsound as an excavator attachment given the imbalance that will arise during operation. Furthermore, the presence of the carrier or external support arm would prevent this embodiment being used effectively as a versatile attachment for an excavator for the same reasons as described with respect to the embodiment of FIG. 1 of GB 1,359,204.

The embodiment of FIG. 4 of GB 1,359,204 has a similar construction to that of FIG. 3 but is mushroom shaped and lacks an external support arm. The screwed attachment of the intermediate shaft to the rotating part (serving as the rotating output shaft) of the motor, and the keying to the intermediate shaft of a bush to which the drum is attached would not be suitable for operating against heavy loads given the two piece nature of the output shaft and the cantilevered drum which is fitted around the intermediate shaft and bush. The shaft is cylindrical and the bush provides a matching cylindrical bore which, because of the slight clearance between the adjacent cylindrical surfaces and the single localized connection of the drum to the shaft, produces a "flogging" force between the bush and shaft, which, over time, allows the drum to seize upon the housing. Indeed, this deficiency in the construction of the mining cutting tool of FIG. 4, which is also present in the miring cutting tool of FIG. 3, was addressed by the modifications made to the tool disclosed in GB 1,419,714, where gears were utilized.

It is an object of the present invention to overcome or at least substantially ameliorate the problems and disadvantages of the prior art.

It is a particular object of the present invention to provide a rotary drum cutting head in which the hydraulic motor driving the drums has a shaft which acts directly, without the involvement of a gear or multi-gear drive train and/or other form of semi-flexible joints to rotate the drums. This object may be achieved by utilizing the drive shaft of the hydraulic motor to rigidly and directly rotatably support the drums, thereby integrating the drive and driven shafts to provide a single integral shaft for rigidly and directly rotatably supporting the drums.

SUMMARY OF THE INVENTION

In accordance with the invention, there is provided a rotary drum cutting head comprising a pair of rotary drums which present a plurality of cutting implements adapted for milling rock or other excavatable terrain, and a hydraulic motor having a rotatable output shaft to which the drums are rigidly and directly connected at respective opposed ends of the shaft, wherein the hydraulic motor is centrally disposed between the pair of rotary drums such that the output shaft of the hydraulic motor has a pair of opposed driven ends extending in opposite directions from the motor in longitudinal alignment with the rotational axis of the rotary drums, and wherein the driven ends of the output shaft rotatably support the rotary drums.

BRIEF DESCRIPTION OF THE DRAWINGS

In order that the invention may be readily understood and put into practical effect, reference will be made to the accompanying drawings, in which.

DETAILED DESCRIPTION OF A PRIOR ART EMBODIMENT

Figure 1:
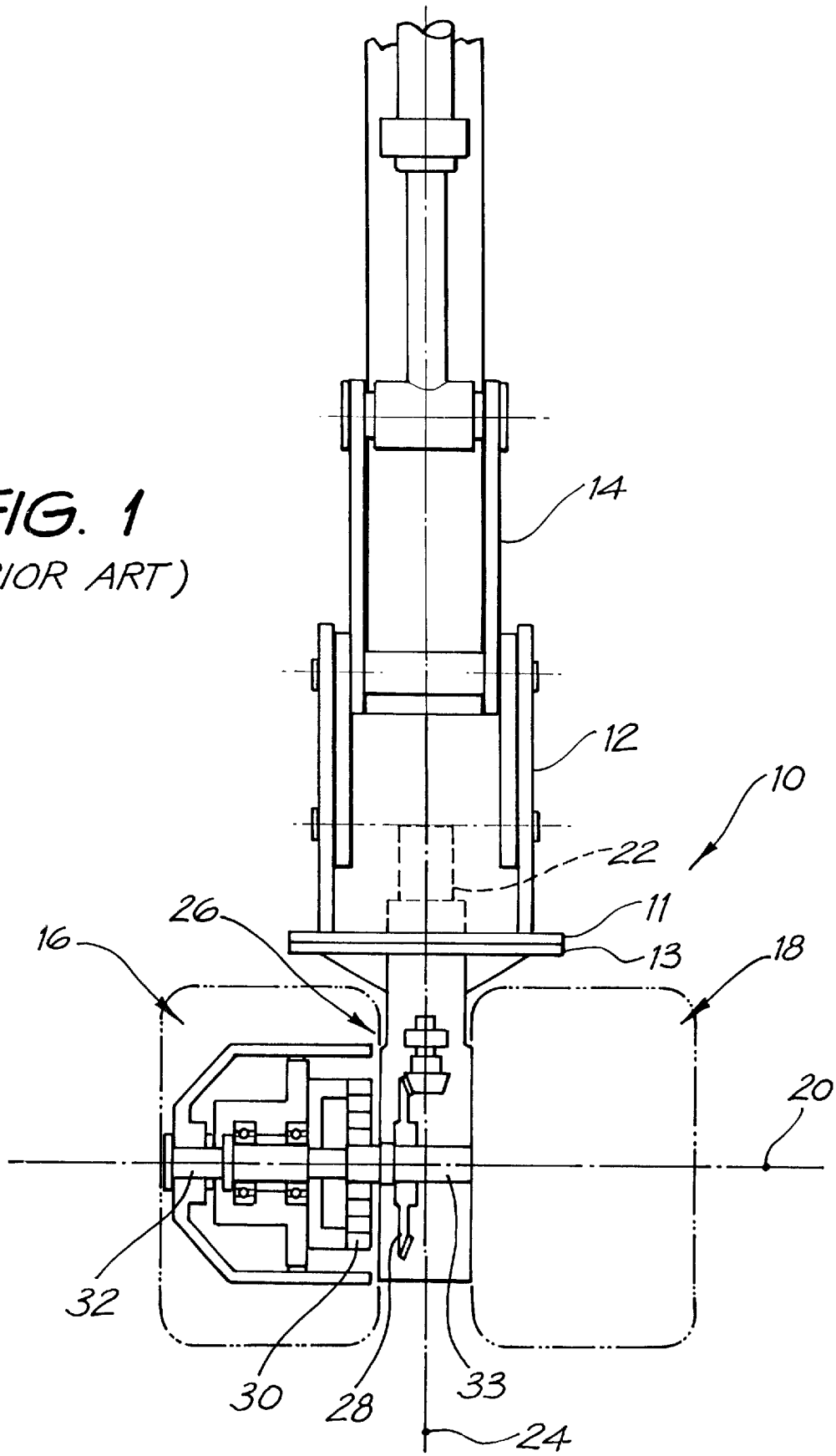
FIG. 1 (PRIOR ART)
FIG. 1 is a front view of a rotary drum cutting head and dipper arm adaptor therefor of the prior art connected to the dipper arm of an excavator.

The prior art rotary drum cutting head 10 and dipper arm adaptor 12 shown in FIG. 1 are rigidly connected to each other through abutting brackets 11 and 13, with the adaptor 12 being connected to the dipper arm 14 of an excavator by a conventional articulating linkage. The cutting head 10 consists of a pair of rotary drums 16, 18 which are adapted to support rock cutting implements, such as round shank picks, or implements for scaling, grinding or otherwise milling excavatable terrain. The rotary drums 16, 18 are simultaneously driven to rotate about their common axis 20 by a hydraulic motor 22 located within the dipper arm adaptor 12. The hydraulic motor 22, (which is fed with oil under pressure from the hydraulic circuitry of the excavator) has a drive shaft which is caused to rotate about its longitudinal axis 24 and is connected to a multi-gear drive train for rotating the rotary drums 16, 18 about their own dedicated shafts 32, 33, respectively, having longitudinal axis 20 which extends perpendicularly to axis 24. The drive train consists of a train of drive shaft aligned reduction gears 26 that act on a crown wheel and pinion 28 that, in turn, acts on planetary gears 30 for each of the rotary drums 16, 18. The internal features of rotary drum 16 only are shown in FIG. 1, but the internal features of rotary drum 18 are identical.

As will be apparent from the foregoing description of the prior art rotary drum cutting head 10 of FIG. 1, the presence of a multi-gear drive train between the drive shaft of the hydraulic motor 22 and the driven shafts 32, 33 of the rotary drums 16, 18 comprises a significant number of components which can contribute to loss of efficiency and tedious, expensive maintenance and overhaul.

DETAILED DESCRIPTION OF THE INVENTION

Figure 2:
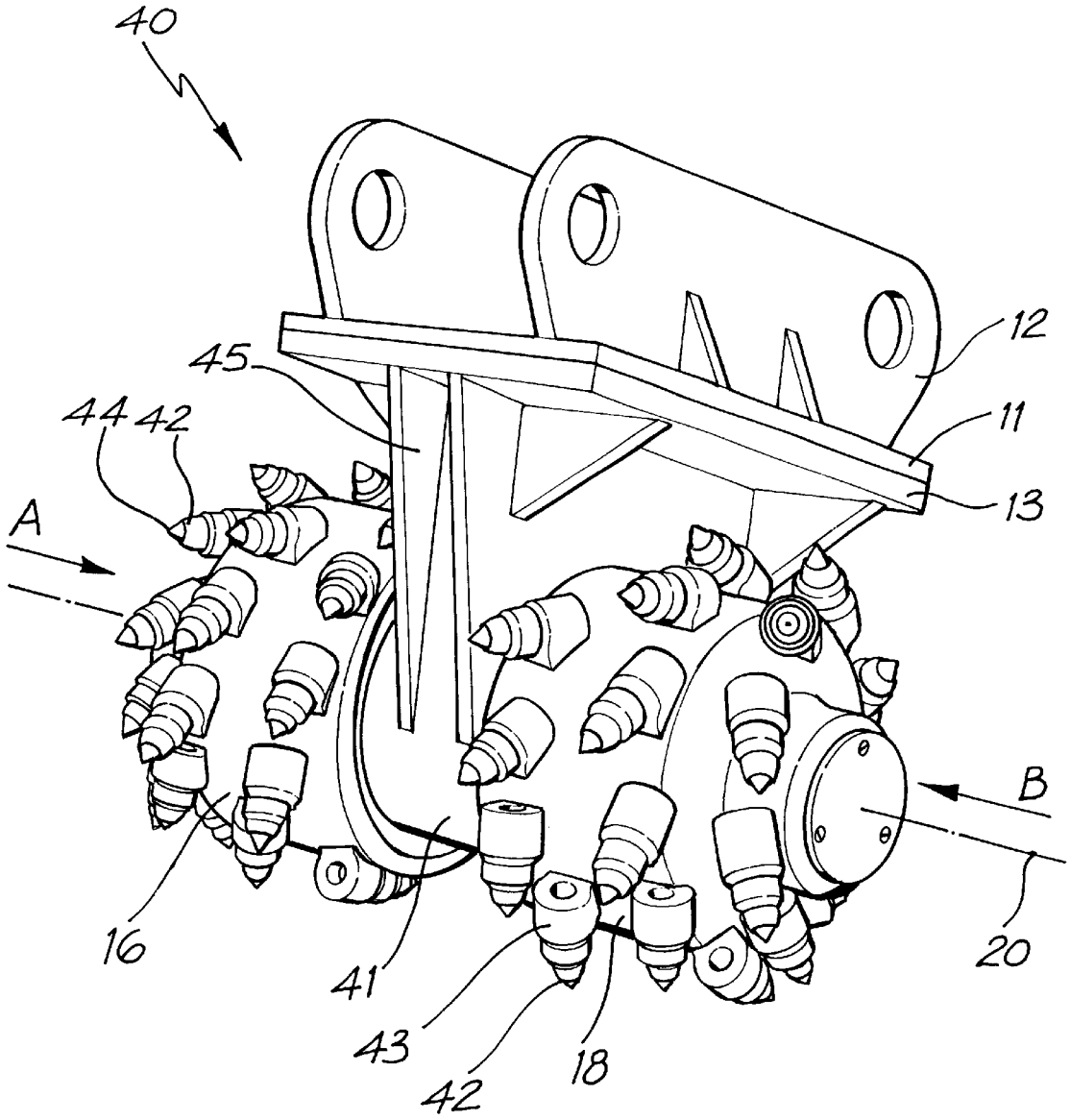
FIG. 2 is a perspective view of a rotary drum cutting head according to a preferred embodiment of the present invention.
Figure 3:
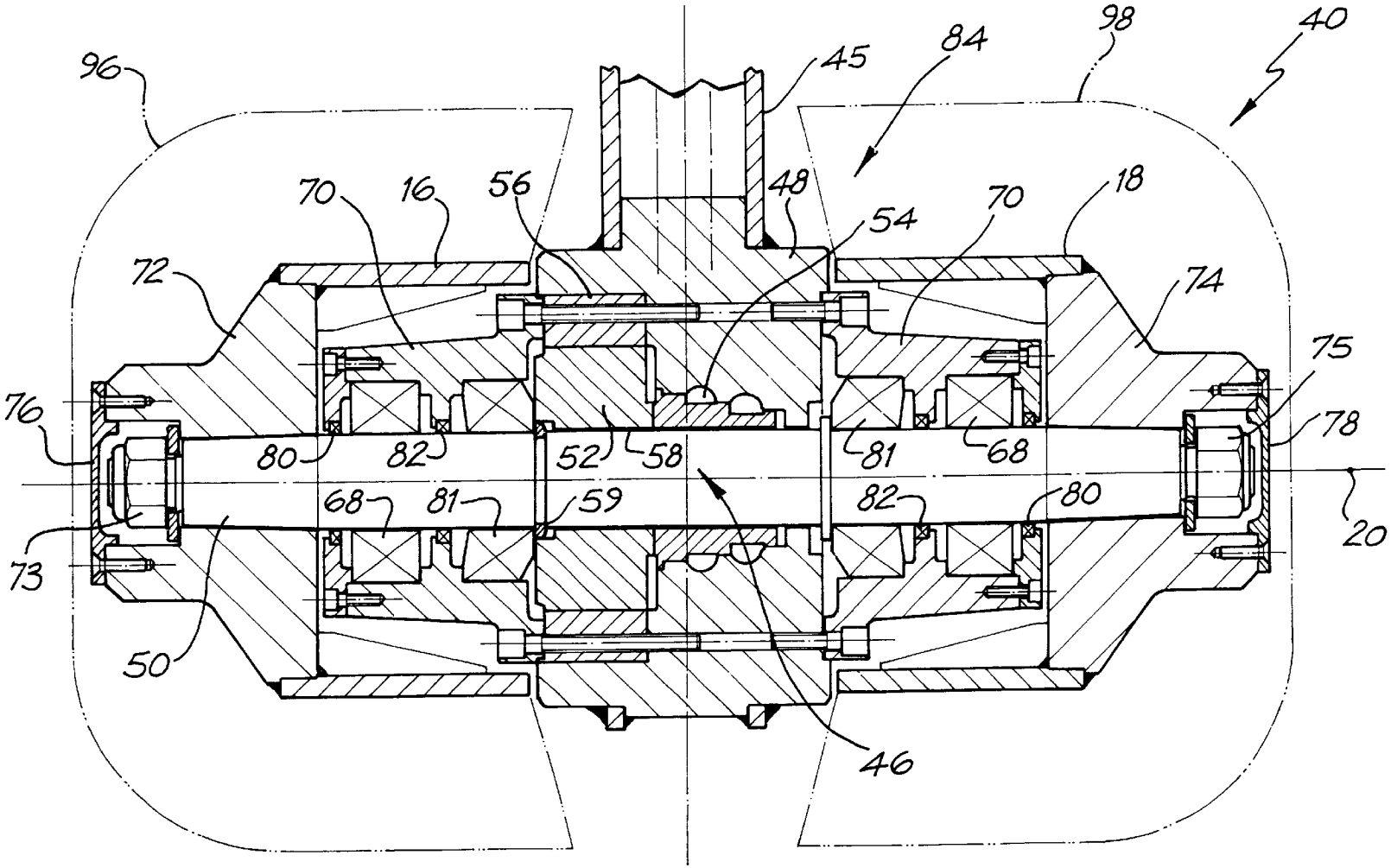
FIG. 3 is a front sectional view of the cutting head of FIG. 2 (but not including the cutting implements borne on the drums, or the entire cutting head main body, or the dipper arm adaptor therefor)
Figure 5:
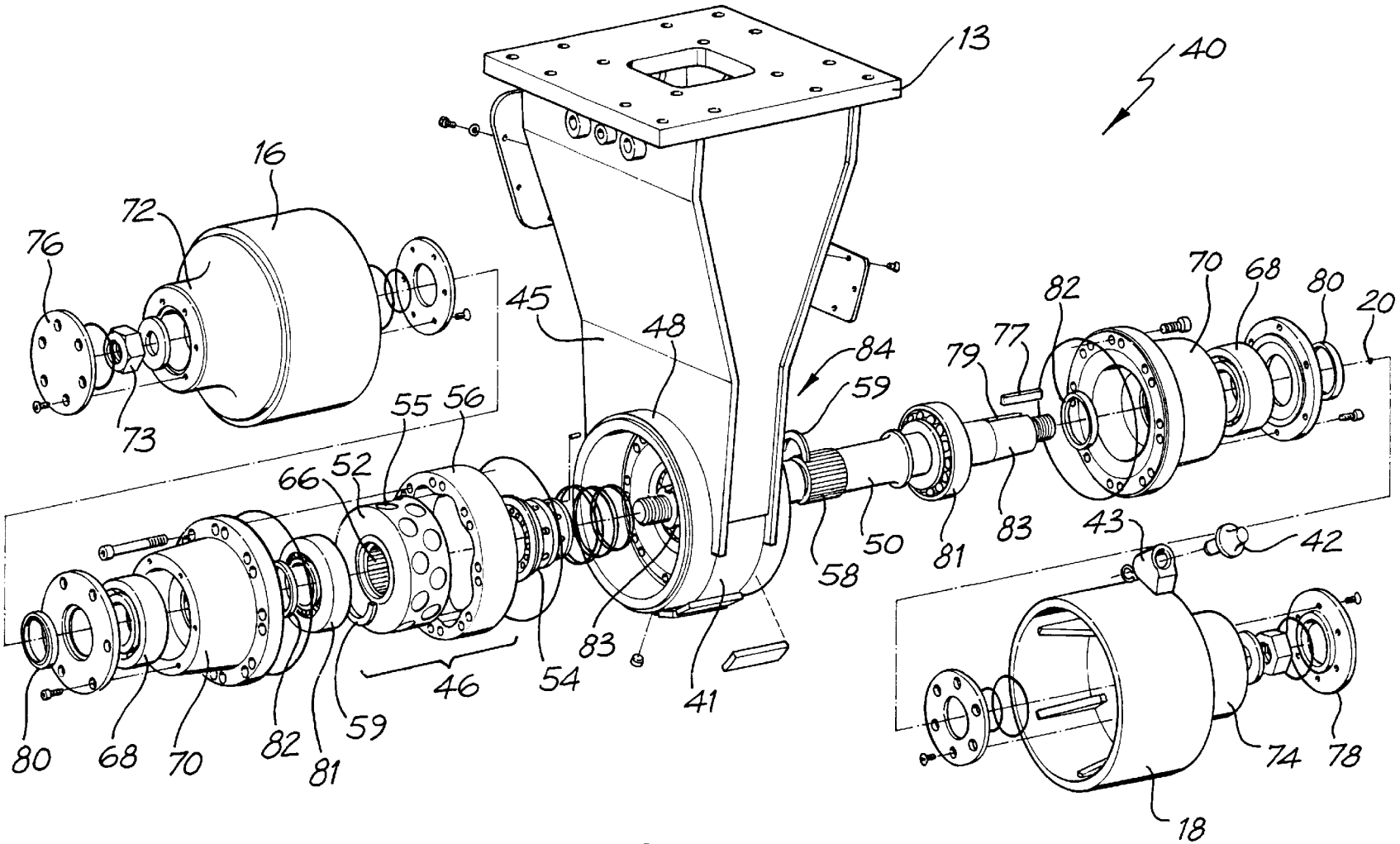
FIG. 5 is an exploded view of the cutting head of FIG. 3 (and including the entire cutting head main body and a single one of a plurality of cutting implements borne on the drums).

The rotary drum cutting head 40 shown in FIGS. 2, 3 and 5 avoids these problems by utilizing the drive shaft of the hydraulic motor, suitably and symmetrically supported by bearings, as the driven shaft to rigidly and directly rotatably support the drums without the interposition of gears, thereby ensuring that power is transferred with minimal moving components directly and efficiently from the hydraulic motor to the drums via a single integral shaft serving as both the drive and driven shafts of the prior art.

For the sake of brevity, features of the cutting head 40 which are similar to features of the prior art cutting head 10 are identified hereafter and in FIGS. 2, 3 and 5 by the same numerals as are used in FIG. 1.

The cutting head 40 is shown in FIG. 2 presenting a plurality of spirally arranged rock cutting and mixing picks 42 on both of its rotary drums 16, 18.

Only the outline profiles (96, 98) of the picks 42 are shown in FIG. 3. The picks 42 are attached to each drum 16, 18 through individual mounting brackets 43 with the pattern of picks 42 being loosely based on a two start helical spiral. However, a three, four or other multiple start helical spiral may be used depending, on the cutting requirements of the cutting head. The receding direction of the spiral on the left side drum 16, (as viewed from its exposed end as per arrow A) is counterclockwise, and the receding direction of the spiral on the right side drum 18 (as viewed from its exposed end as per arrow B) is clockwise. It will be appreciated by skilled persons in the art that the directions of the spirals may be reversed in certain instances. Each pick 42 has, in this instance, a tungsten carbide tip 44 to retard the rate of wear of the pick 42 such as may otherwise result, say, from prolonged sandstone excavation.

The cutting drums 16, 18 are separated by a central yoke portion 41 of the cutting head main body 84 shown sectionally in FIG. 3. The yoke portion 41 is connected to a neck portion 45 extending to bracket 13. The bracket 13 enables the cutting head 40 to be turned 90° from its normal working position for trenching purposes.

As shown in FIGS. 3 and 5, the main body 84 encloses a hydraulic motor 46 (also known as a hydraulic torque generator) in a housing 48 therefor, and a single piece output shaft 50 of the hydraulic motor 46 extends in opposed directions from the housing 48. The hydraulic motor 46 has a cylinder block 52 (also known as a rotor), a valve arrangement 54 and a multi-cammed ring 56 (similar in operation to the type known in the industry as CAMTRACK™ as manufactured by Poclain Hydraulics of France).

Figure 4:
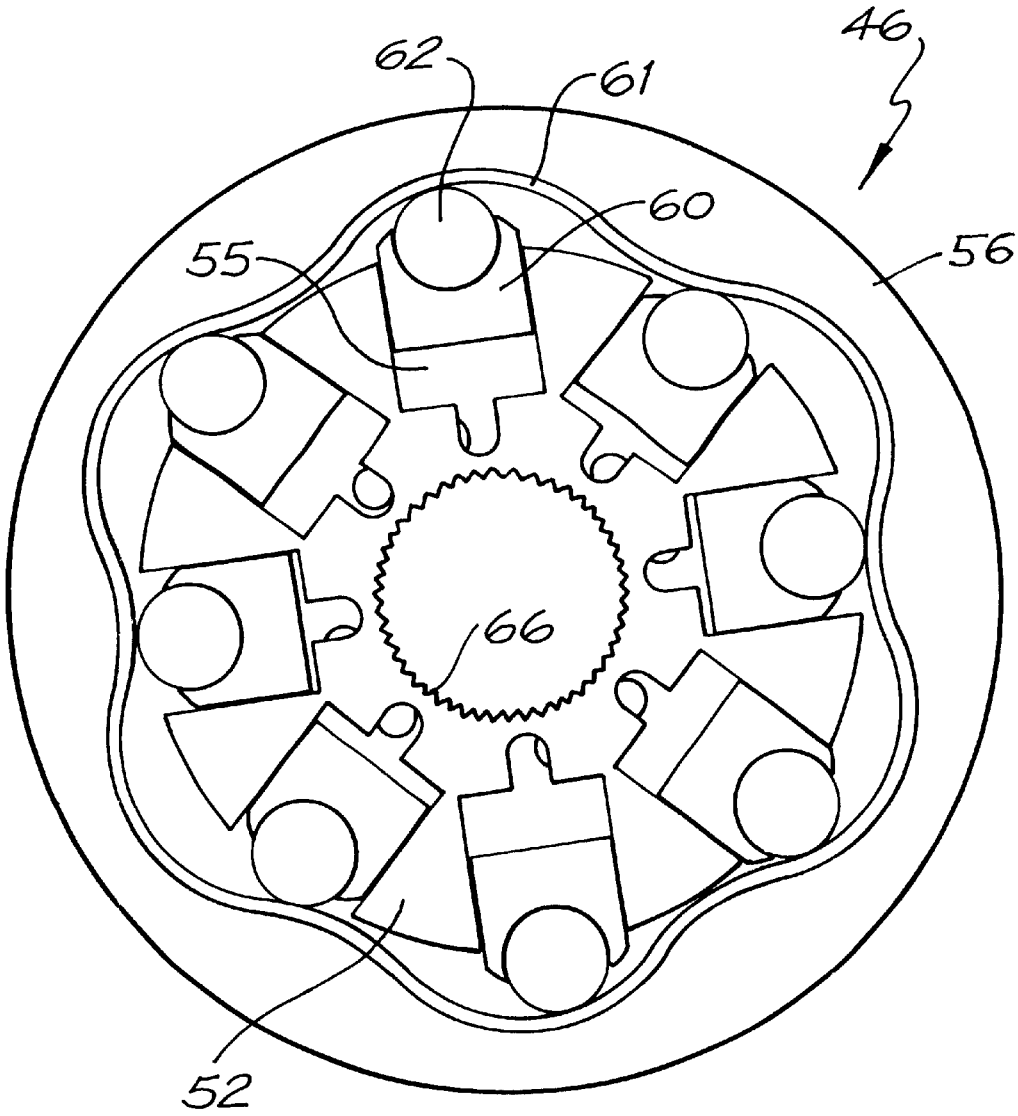
FIG. 4 is a schematic view of a preferred hydraulic motor of the radial piston type that may be used to drive the cutting head of FIGS. 2 and 3.

The configuration of the hydraulic motor 46 which, in this case, is of the radial roller piston type shown schematically in FIG. 4, controls the rotating movement of output shaft 50 about its longitudinal axis which is coaxially aligned with the rotating axis of the cylinder block 52. Hydraulic fluid, supplied and returned through galleys in the housing 48 and through hydraulic valving and control units mounted within the neck portion 45 of the main body 84, forces the radial pistons 60, which are reciprocatingly mounted in tightly fitting chambers 55 formed in the cylinder block 52, outwardly to the cam surface 61 (shown as an undulating or wavy circle) of ring 56, so that the rollers 62 are caused to roll along the cam surface 61 and thereby cause the cylinder block 52 to rotate. The cylinder block 52 has annularly disposed teeth 66 which are meshingly engaged to the output shaft 50 via a splined portion 58 of the shaft 50, thereby directly causing the shaft 50 to rotate. The shaft 50 has a split ring 59 adjacent to the splined portion 58. The split ring 59 may be readily replaced by any form of retainer, such as a specially adapted circlip.

The hydraulic motor 46 can supply up to 43,000 Nm of torque at speeds of from 30 to 90 rpm depending on the cutting requirements and the drum configuration.

The housings 70 control the pre-load of the symmetrically opposed pair of taper roller bearings 81. The taper roller bearings 81 serve as inward bearings and there are a pair of symmetrically opposed outward bearings 68, both pairs of bearings 81, 68 being housed in their respective housings 70. Together, the housings 70 and bearings 81 secure the hydraulic motor 46 in As position with respect to the main body 84 relative to the output shaft 50. Bearings 68 assist the bearings 81 to support and balance the shaft 50 at its opposed ends and both bearings 68, 81 relieve the hydraulic motor of substantial reaction stresses.

Backlash is overcome by the supply of variable flow oil to the hydraulic motor 46. Backlash is a common problem in prior art gear driven rotary drum cutting heads. A variable flow oil pump mounted in the excavator supplies oil at a constant pressure but with varying volumes so that when the drums 16, 18 experience a drop in their speed as a result of meeting resistance from the workface, oil is shunted away from the motor 46 to allow the optimum volume of oil to be present in the motor 46 at all times and the shunted oil is returned to a tank for the pump. Variable flow oil protects the splined portion 58 from wear due to some backlash that might otherwise occur. Any gears or gear drive downstream of the output shaft 50 would reintroduce a backlash and wear problem.

The near terminii regions 83 of the shaft 50 are slightly inwardly tapered so as to match and be lockably received by interference fit in inwardly tapered portions of respective hubs 72, 74 which are an integral part of the drums 16, 18. Keys 77 fit in matching keyways 79 formed in the regions 83 and in the tapered portions of the hubs 72, 74 to assist the locking. Nuts 73, 75 secure the shaft 50 as its ends to the hubs 72, 74 and drum hub caps 76, 78 cover the nuts 73, 75. The bearings 81 are lubricated by the hydraulic motor oil and sealed by oil seals 82. Grease seals 80 prevent grease loss and contamination of the bearings 68. Grease may be packed in the bearings for the life of the cutting head or for required periods of operating life (i.e. between maintenance periods). The seals may allow for underwater operation to a depth of about 10 metres.

It is an advantage of the rotary drum cutting head of the present invention that it can efficiently and reliably grind, dig, scale or otherwise remove material such as rock, sandstone, concrete, asphalt and the like from sites which can normally be accessed by excavators. As would be apparent to the skilled person in the art, the present invention can be widely used in roadworks, building excavation, demolition, mining and tunnelling to achieve efficient material removal by grinding and finishing with the one tool, thereby largely avoiding the need for secondary crushing with another tool. As a result, operating efficiency is improved. There are also reduced maintenance requirements leading to less operating downtime stemming from the absence of gears and/or semi-flexible joints, which further provides a smoother torque delivery to the drums.

It is another advantage of the present invention that two cutting drums may be driven from a hydraulic motor with a single output shaft. The hydraulic motor, preferably of the radial roller piston type, is mounted not in the cutting drums (as in the prior art) but in a centrally located housing of the cutting head, thereby facilitating the fixing of the outer stationary part of the radial roller piston hydraulic motor and the rotation of the inner rotating part in coaxial and continuous alignment with the output shaft.

Various other modifications may be made in details of design and construction without departing from the scope or ambit of the invention.

For example, where it is required to utilize a rotary drum cutting head of smaller size or load capacity, a cutting head may be manufactured without the pair of outward bearings 68.

What is claimed is:

1. A rotary drum cutting head comprising a pair of rotary drums which present a plurality of cutting implements adapted for milling rock or other excavatable terrain, and a single hydraulic motor having a rotatable output shaft to which the drums are rigidly and directly connected at respective opposed ends of the shaft, wherein the hydraulic motor is centrally disposed between the pair of rotary drums such that the output shaft of the hydraulic motor has a pair of opposed driven ends extending in opposite directions from the motor in longitudinal alignment with the rotational axis of the rotary drums, and wherein the driven ends of the output shaft rotatably support the rotary drums.

2. The rotary drum cutting head of claim 1 wherein the hydraulic motor is mounted in a housing located centrally between the pair of rotary drums.

3. The rotary drum cutting head of claim 2 wherein the hydraulic motor is a radial roller piston hydraulic motor.

4. The rotary drum cutting head of claim 3 wherein the radial roller piston hydraulic motor has an outer stationary part which is fixed to the housing and an inner rotating part which is rotatable.

5. The rotary drum cutting head of claim 4 wherein the output shaft has a rotational axis and the axis of rotation of the inner rotating part of the hydraulic motor is in continuous alignment with the rotational axis of the output shaft.

6. The rotary drum cutting head of claim 1 and including symmetrically opposed first and second pairs of bearings which support the output shaft, both the first and second pairs of bearings being mounted in housings located within the rotary drums.

7. A rotary drum cutting head comprising a pair of rotary drums which present a plurality of cutting implements adapted for milling rock or other excavatable terrain, and a hydraulic motor having a rotatable output shaft to which the drums are rigidly and directly connected at respective opposed ends of the shaft, wherein the hydraulic motor is centrally disposed between the pair of rotary drums such that the output shaft of the hydraulic motor has a pair of opposed driven ends extending in opposite directions from the motor in longitudinal alignment with the rotational axis of the rotary drums, and wherein the driven ends of the output shaft rotatably support the rotary drums and wherein the rotary drum cutting head comprises symmetrically opposed first and second pairs of bearings which support the output shaft, both the first and second pairs of bearings being mounted in housings located within the rotary drums.

* * * * *